US010377027B2

(12) United States Patent
Huang

(10) Patent No.: US 10,377,027 B2
(45) Date of Patent: Aug. 13, 2019

(54) COMPOSITE STAPLE MAGAZINE FOR TACKERS

(71) Applicant: Tsung-Wen Huang, Chang Hua County (TW)

(72) Inventor: Tsung-Wen Huang, Chang Hua County (TW)

( * ) Notice: Subject to any disclaimer, the term of this patent is extended or adjusted under 35 U.S.C. 154(b) by 548 days.

(21) Appl. No.: 15/062,274

(22) Filed: Mar. 7, 2016

(65) Prior Publication Data

US 2017/0252914 A1 Sep. 7, 2017

(51) Int. Cl.
*B25C 5/16* (2006.01)

(52) U.S. Cl.
CPC ..... *B25C 5/1617* (2013.01); *B25C 5/1644* (2013.01); *B25C 5/1658* (2013.01)

(58) Field of Classification Search
CPC ..... B25C 5/161; B25C 5/1637; B25C 1/047; B25C 5/16; B25C 1/005
USPC ..... 227/120, 135, 139
See application file for complete search history.

(56) References Cited

U.S. PATENT DOCUMENTS 2,625,682 A * 1/1953 Cristiano ..... B25C 1/04 227/5
2,801,415 A * 8/1957 Jenny ..... B25C 1/041 173/169
3,056,137 A * 10/1962 Wandel ..... B25C 1/047 227/127
3,058,114 A * 10/1962 Haubold ..... B25C 5/16 227/127
4,163,515 A * 8/1979 Kapuscinski ..... B25C 5/025 227/120
6,672,499 B1 * 1/2004 Lee ..... B25C 5/161 227/120
7,044,351 B2 * 5/2006 Ronconi ..... B25C 5/06 227/123
2002/0117531 A1 * 8/2002 Schell ..... B25C 1/005 227/8
2006/0011695 A1 * 1/2006 Ishizawa ..... B25C 1/184 227/120
2006/0102687 A1 * 5/2006 Schnell ..... B25C 1/00 227/130
2011/0180583 A1 * 7/2011 Wang ..... B25C 5/1644 227/109
2012/0187177 A1 * 7/2012 Myburgh ..... B25C 1/005 227/120
2012/0280016 A1 * 11/2012 Segura ..... B25C 1/005 227/120
2013/0221056 A1 * 8/2013 Chen ..... B25C 5/162 227/120

* cited by examiner

*Primary Examiner* — Andrew M Tecco
*Assistant Examiner* — Eyamindae C Jallow
(74) *Attorney, Agent, or Firm* — Bacon & Thomas, PLLC

(57) ABSTRACT

A composite staple magazine for tackers includes a guide member, a receiving body, a support member, a push member, a resilient member and an end member. The receiving body is fixed to the guide member. The support member is made of plastic material and snapped to the receiving body. The support member includes two respective positioning portions which are engaged with the engaging portion of the receiving body. The resilient member is wrapped to the roller of the support member and connected to the push member which is slidably mounted to the receiving body. The resilient member pushes the staples forward. The end member is fixed by a bolt. The composite staple magazine is simple, easily assembled and saves cost.

8 Claims, 8 Drawing Sheets

COMPOSITE STAPLE MAGAZINE FOR TACKERS

BACKGROUND OF THE INVENTION

1. Fields of the Invention

The present invention relates to a staple magazine for tackers, and more particularly, to a composite magazine including a plastic support member which is connected to the receiving body.

2. Descriptions of Related Art

The conventional magazine 80 for tackers is disclosed in FIGS. 10 and 11, and includes a guide member 81, a receiving body 82, a guide plate 83, a roller 84, a spring 85, a push member 86 and an end member 90. The guide member 81 includes two sidewalls and an open top, and the bottom plate 811 is connected to the guide member 81. The bottom plate 811 has multiple slots 812. The receiving body 82 has an open top and has the same width as the receiving path. The receiving body 82 is welded to the bottom plate 811. Multiple protrusions 831 extend from the lower side of the guide plate 83 are fixedly connected to the slots 812 so as to define a receiving path for receiving staples between the receiving body 82 and the guide plate 83. A side hole 821 is defined in each other two sidewalls and the roller 84 is connected between the two side holes. The spring 85 is wrapped to the roller 84 and connected to the push member 86 and the receiving body 82. A metal end member 90 is connected to the open end of the receiving body 82 so as to ensure that the staples are pushed perpendicularly. The magazine can be used with different types of staples such as inverted U-shaped staples, I-shaped staples and T-shaped staples.

Some of the parts of the conventional magazine are made by thin steel plates so as to support and guide the staples. The receiving body 82 and the guide member 81 are welded together, and the guide plate 83 is then connected to the receiving body 82 and the guide member 81 to support and guide the staples. However, the steel plates involve high manufacturing cost and once the welding processes are not precisely done, the magazine cannot operate as desired.

The side holes 821 are made by way of punching, and the roller 84 is made of plastic material so that another mold set is needed to make the roller 84. The roller 84 is small in size which has to be installed slowly and carefully, and this may take a long time to assemble the magazine.

In order to ensure that the staples are pushed perpendicularly relative to the object to be stapled, the end member 90 is welded to the open end of the receiving body 82 to close the open end. The welding process also increases the manufacturing cost and contaminates the environment.

The present invention intends to provide a composite magazine wherein the support member is made by plastic material, and snapped to the receiving body so as to improve the shortcomings mentioned above.

SUMMARY OF THE INVENTION

The present invention relates to a composite magazine for tackers, and comprises a guide member having two sidewalls and an open top. The guide member has a bottom plate and a groove defined between the two sidewalls. A U-shaped receiving body has a bottom and two side panels extend from the bottom. A room is defined axially between the bottom and the two side panels. The receiving body is welded to the bottom plate of the guide member. Multiple engaging portions are respectively formed on inside of the two side panels of the receiving body. A hooking portion is formed on the bottom of the receiving body.

A support member an integral member and made of plastic material. The support member includes a guide plate and a side plate. An end member is connected to one end of the guide plate and the side plate. The end member has a positioning portion, and the side plate has another positioning portion. A roller is connected to the guide plate. The support member is snapped to the room of the receiving body. The positioning portions of the end member and the side plate are engaged with the engaging portions of the receiving body.

A push member has two side portions and is mounted to the two side panels of the receiving body. The push member has a notch defined therein. A resilient member has a first end hooked to the hooking portion of the receiving body, and a second end of the resilient member is wrapped to the roller and hooked to the notch of the push member. An end plate has a cross area that is the same as the area of the open end of the receiving body. A bolt extends through the end plate and threadedly connected to the end member.

The present invention has the advantages which are that the receiving body is snapped to the support member, so that the shortcomings due to welding connection can be eliminated. The assembling efficiency is increased.

The roller and the support member are integrally formed by plastic material so as to save the cost of the steel plates as mentioned in the conventional magazine, and the competition ability in the market is increased.

The end plate is easily connected to the support member by using the bolt, and cooperated with the receiving body to form the staple guiding mechanism. The guide blocks each have an inclined guide face which ensures that the staples are correctly orientated and do not tilt or spin.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENT

Figure 1:
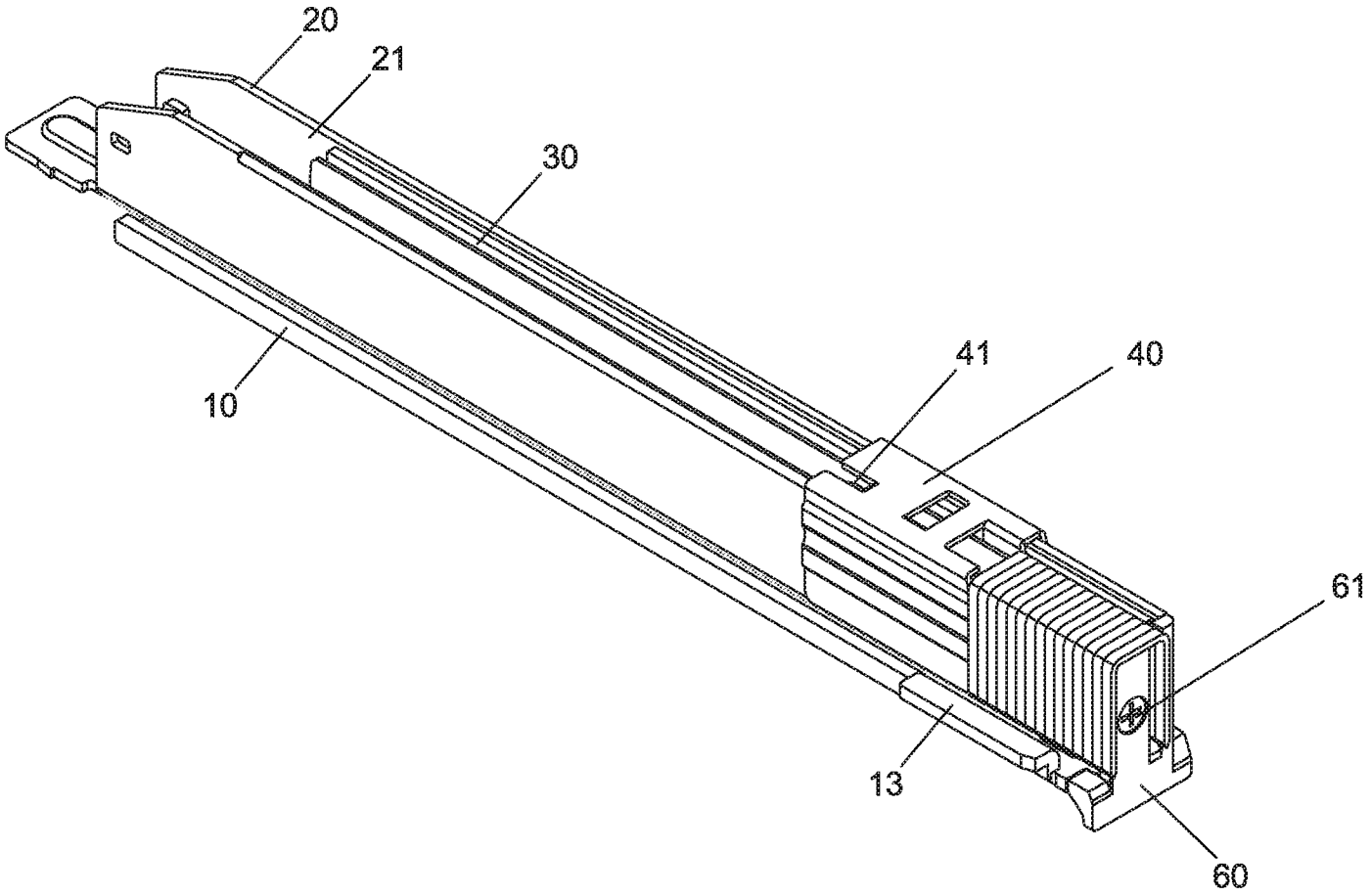
FIG. 1 is a perspective view to show the magazine of the present invention.
Figure 2:
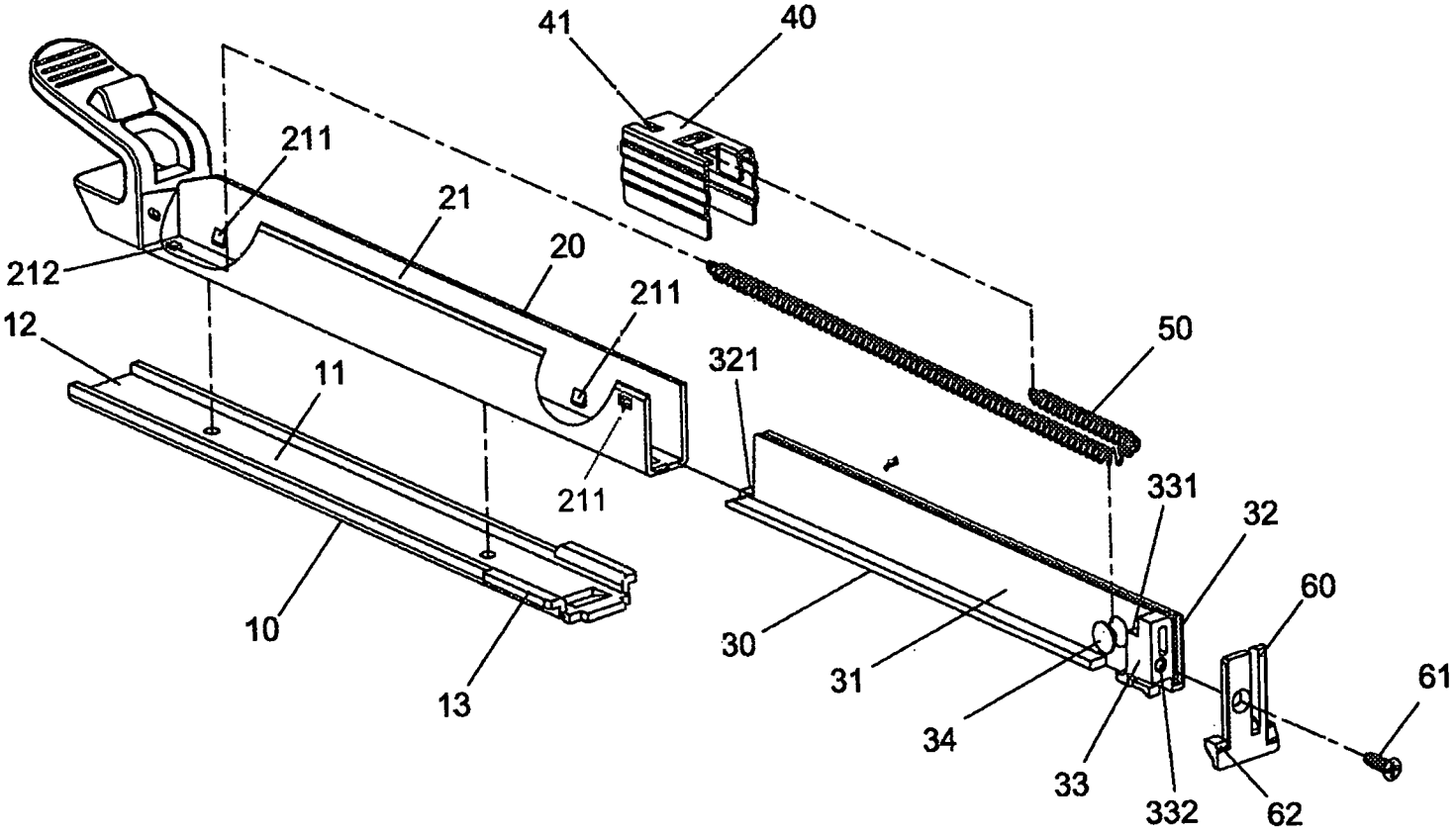
FIG. 2 is an exploded view of the magazine of the present invention.
Figure 3:
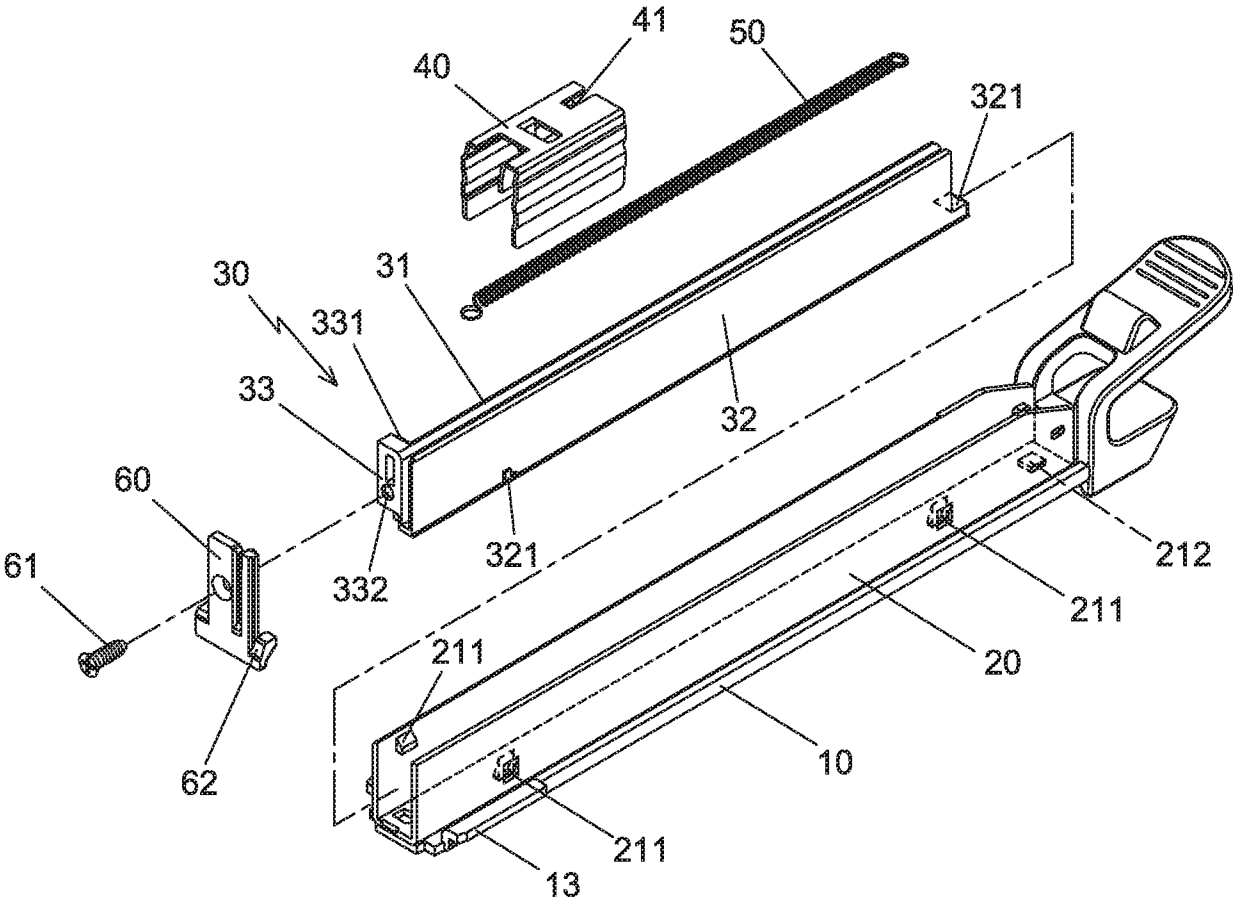
FIG. 3 is another exploded view of the magazine of the present invention.

Referring to FIGS. 1 to 3, the composite magazine for tackers of the present invention comprises a guide member 10 having two sidewalls and an open top, wherein the guide member 10 has a bottom plate 11 and a groove 12 is defined between the two sidewalls. A wing 13 extends outward from each of the two sidewalls of the guide member 10, and the wings 13 are located close to one end of the guide member 10.

A U-shaped receiving body 20 has a bottom and two side panels which extend from the bottom. A room 21 is defined axially between the bottom and the two side panels. The receiving body 20 is welded to the bottom plate 11 of the guide member 10. Multiple engaging portions 211 are respectively formed on inside of each of the two side panels of the receiving body 20. A hooking portion 212 is formed on the bottom of the receiving body 20. The wings 13 on the guide member 10 are located close to one end of the guide member 10 and located corresponding to the open end of the receiving body 20.

A support member 30 is an integral member and made of plastic material. The support member 30 includes a guide plate 31 for supporting the staples, and a side plate 32 for guiding the staples. The guide plate 31 and the side plate 32 are parallel to the side panels of the receiving body 20. An end member 33 is connected to one end of the guide plate 31 and the side plate 32. The end member 33 has a positioning portion 331, and the side plate 32 has another positioning portion 321. A roller 34 is formed to the guide plate 31. The support member 30 is inserted into the room 21 of the receiving body 20. The positioning portions 331, 321 of the end member 33 and the side plate 32 are engaged with the engaging portions 211 of the receiving body 20. The end member 33 has a threaded hole 332.

A push member 40 has two side portions and is mounted to the two side panels of the receiving body 20. The push member 40 has a notch 41 defined therein.

A resilient member 50 has the first end thereof hooked to the hooking portion 212 of the receiving body 20, and the second end of the resilient member 50 is wrapped to the roller 34 and hooked to the notch 41 of the push member 40.

An end plate 60 has a cross area which is the same as the area of the open end of the receiving body 20. A bolt 61 extends through the end plate 60 and is threadedly connected to the threaded hole 332 of the end member 33. The end plate 60 has two guide blocks 62 respectively on two sides thereof, and each of the guide blocks 62 has an inclined guide face which faces the staples.

When assembling, the receiving body 20 is welded to the guide member 10, and the plastic support member 30 is then inserted into the room 21. The parallel guide plate 31 in the room 21 is cooperated with the side plate 32 and the side panels of the receiving body 20 to form different support means for different types of staples. The side plate 32 and the end member 33 are snapped to the engaging portions 211 of the receiving body 20 by the positioning portions 321, 331 so that the support member 30 is secured to the receiving body 20. The resilient member 50 has the first end hooked to the hooking portion 212 of the receiving body 20, and the second end of the resilient member 50 is wrapped to the roller 34 and is engaged with the notch 41 of the push member 40. The push member 40 mounted to the receiving body 20 resiliently pushes the staples forward. The end plate 60 is connected to the end member 33 by the bolt 61. The cover 71 is mounted to the top of the receiving body 20 to complete the assembly.

Because the support member 30 is an integral member and made of plastic material, such that the cost of steel plates as used in the conventional magazines is saved. The snapping engagement between the support member 30 and the receiving body 20 is easily and does not have the shortcomings of the method of welding as mentioned before.

The roller 34 is formed on the guide plate 31, so that no side holes are needed to be drilled through the receiving body 20.

Figure 6:
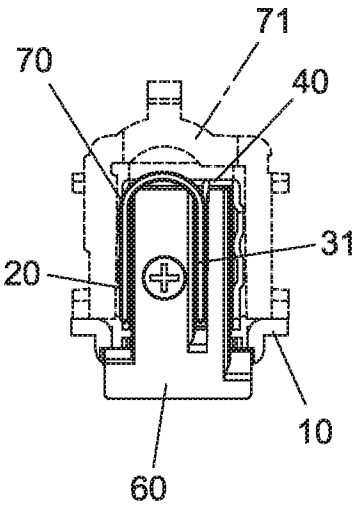
FIGS. 4 to 8 show that the magazine of the present invention is cooperated with different types of staples.
Figure 5:
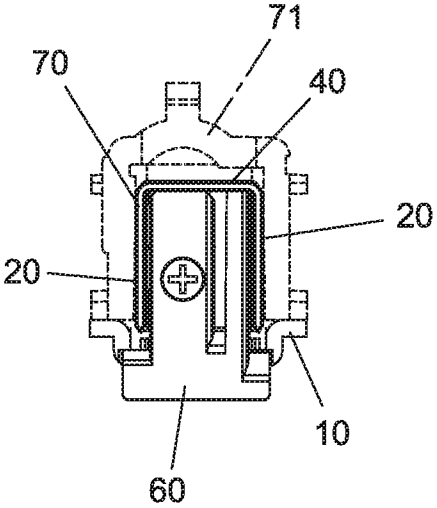
Figure 4:
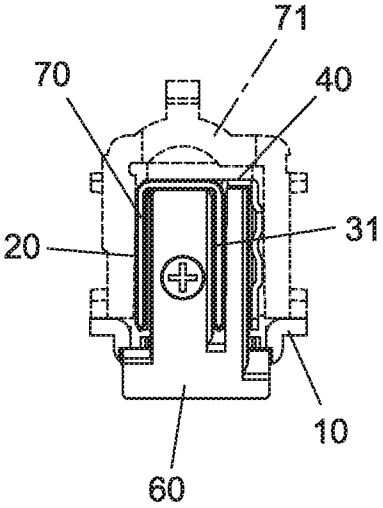
Figure 8:
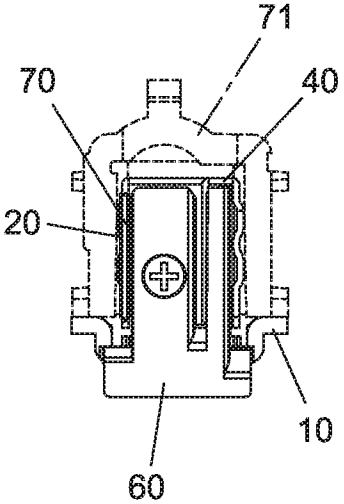
Figure 7:
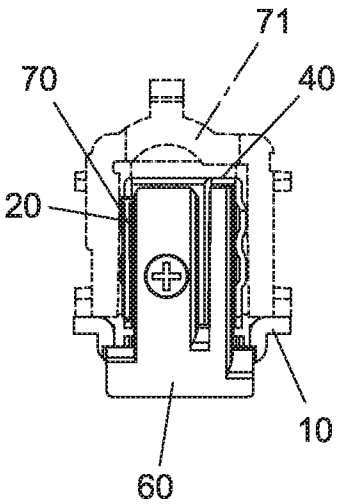

As shown in FIGS. 4 to 8, the support member 30 is snapped into the room 21 of the receiving body 20, and the cover 71 is installed to form the space for guiding the staples 70 of different sizes and shapes. As shown in FIGS. 4 and 6, the narrow inverted U-shaped staples and wide inverted U-shaped staples are mounted to one side panel of the receiving body 20 and the guide plate 31 of the support member 30. As shown in FIG. 5, the even wider staples are mounted to the two side panels of the receiving body 20. As shown in FIGS. 7 and 8, the T-shaped staples and I-shaped staples are located in the space between one side panel of the receiving body 20 and the cover 71. All of the staples are pushed forward by the push member 40.

Figure 9:
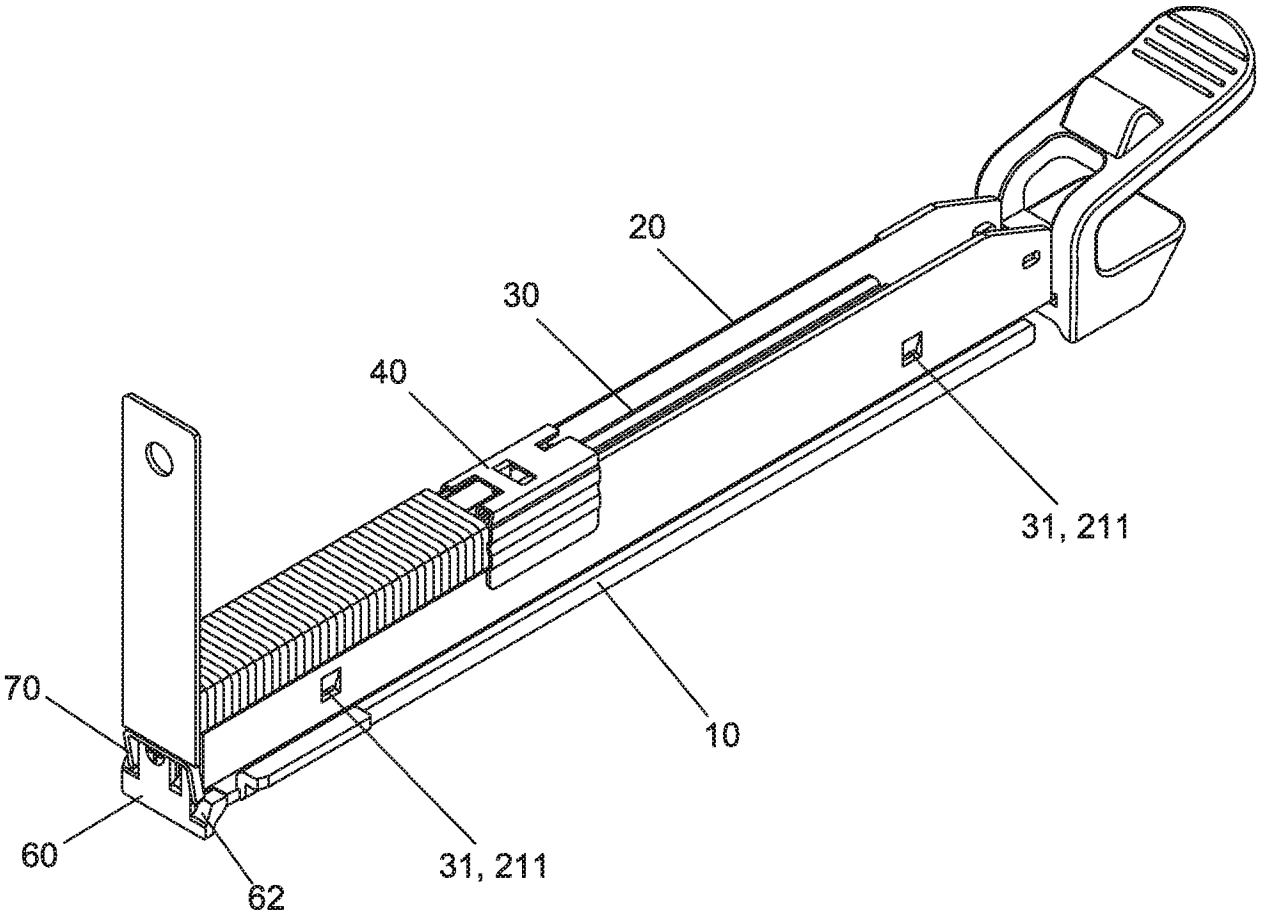
FIG. 9 shows that the magazine of the present invention is cooperated with the short inverted U-shaped staples.
Figure 10:
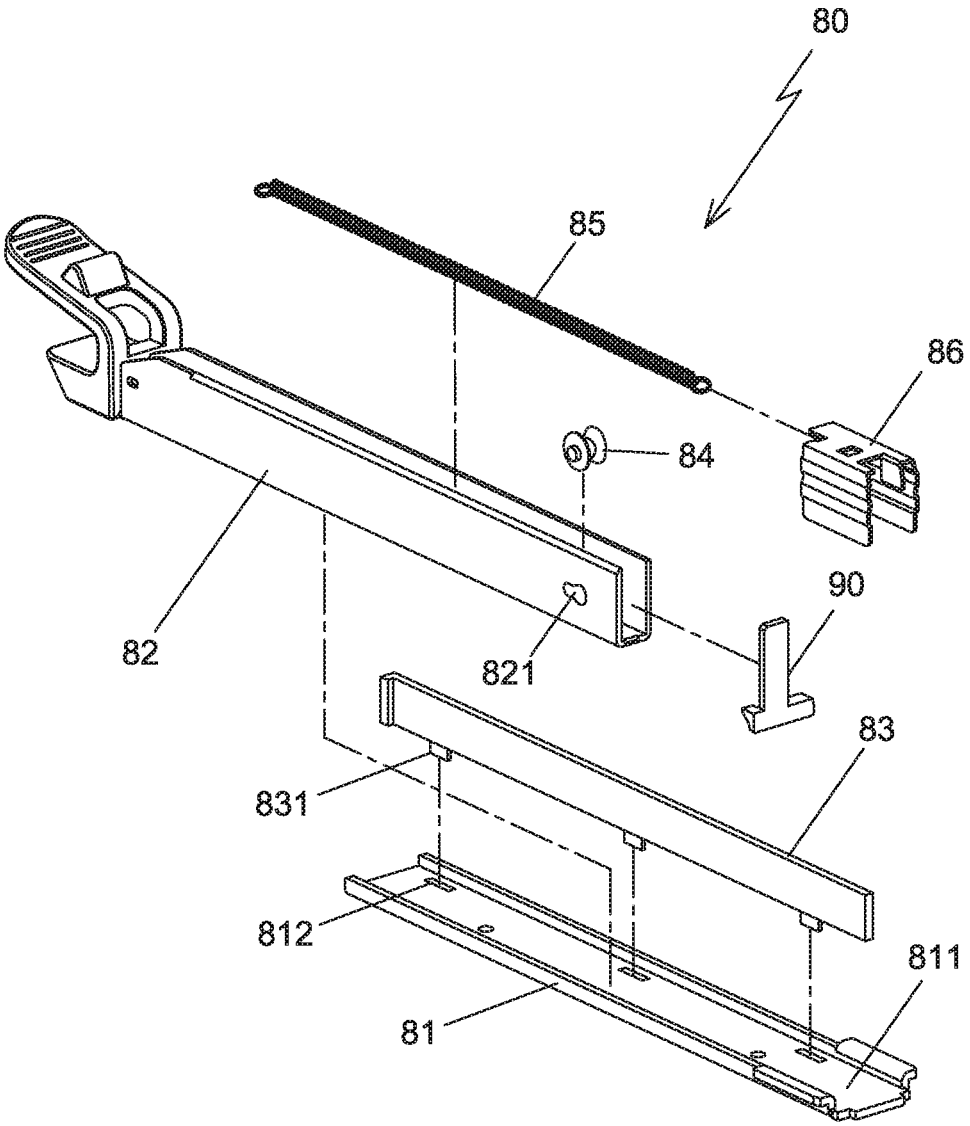
FIG. 10 PRIOR ART
FIG. 10 is an exploded view of the conventional magazine.
Figure 11:
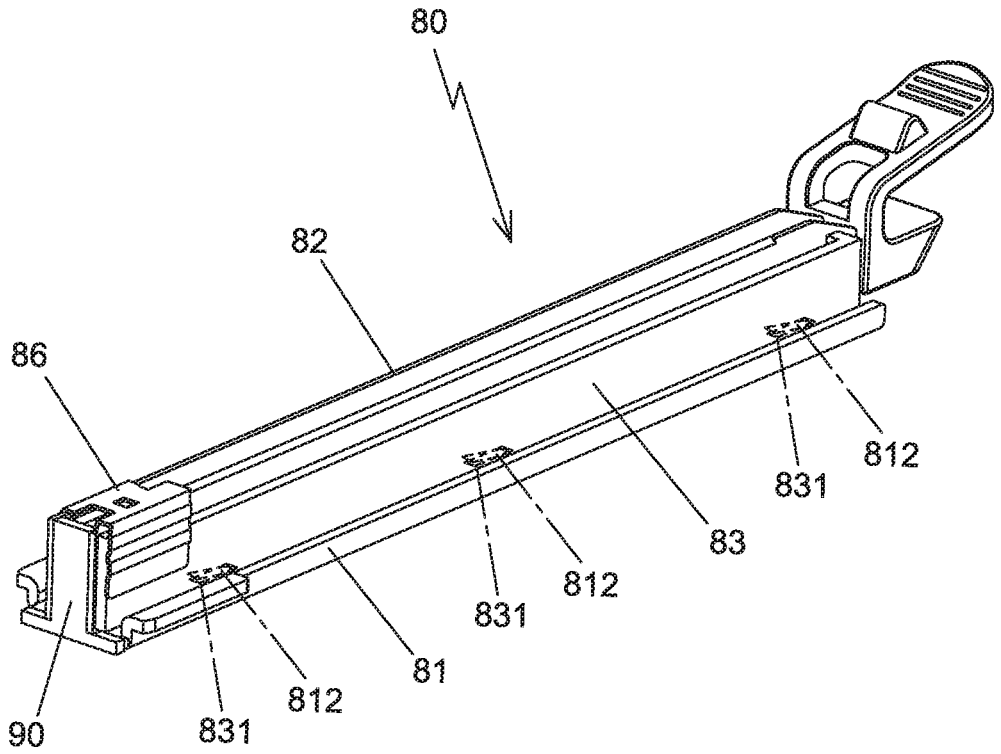
FIG. 11 PRIOR ART
FIG. 11 is a perspective view to show the conventional magazine.

The end plate 60 is connected to the open end of the receiving body 20 by connecting the bolt 61 to the threaded hole 332 of the end member 33. The guide blocks 62 each have an inclined guide face to guide the staples not to tilt or spin as shown in FIGS. 1 and 9.

While we have shown and described the embodiment in accordance with the present invention, it should be clear to those skilled in the art that further embodiments may be made without departing from the scope of the present invention.

What is claimed is:

1. A composite magazine for tackers, comprising:

a guide member having two sidewalls and an open top, the guide member having a bottom plate and a groove defined between the two sidewalls;

a U-shaped receiving body having a bottom and two side panels extending from the bottom, a room defined axially between the bottom and the two side panels, the receiving body being welded to the bottom plate of the guide member, multiple engaging portions respectively formed on inside of each of the two side panels of the receiving body, a hooking portion formed on the bottom of the receiving body;

a support member made of plastic material and being an integral member, the support member including a guide plate and a side plate, an end member connected to one end of the guide plate and the side plate, the end member having a first positioning portion, the side plate having at least one second positioning portion, a roller formed to the guide plate, the support member being inserted into the room of the receiving body, the first positioning portion of the end member and the at least one second positioning portion of the side plate being engaged with the engaging portions of the receiving body;

a push member having two side portions and mounted to the two side panels of the receiving body, the push member having a notch defined therein;

a resilient member having a first end hooked to the hooking portion of the receiving body, a second end of the resilient member wrapped to the roller and being hooked to the notch of the push member, and an end plate having a cross area which is the same as an area of the open end of the receiving body, a bolt extending through the end plate and threadedly connected to the end member;

wherein at least one of the multiple engaging portions of the receiving body is formed on the bottom and located close to the open end of the receiving body, and the end member further has a third positioning portion that is engaged with the at least one of the multiple engaging portions formed on the bottom of the receiving body.

2. The composite magazine for tackers as claimed in claim 1, wherein a wing extends outward from each of the two sidewalls of the guide member, and the wings are located close to one end of the guide member and located corresponding to the open end of the receiving body.

3. The composite magazine for tackers as claimed in claim 1, wherein the end plate has two guide blocks on two sides thereof so as to be adapted to guide staples.

4. The composite magazine for tackers as claimed in claim 3, wherein each of the guide blocks has an inclined guide face which is adapted to face the staples.

5. The composite magazine for tackers as claimed in claim 1, wherein the end member has a threaded hole to which the bolt is threadedly connected.

6. The composite magazine for tackers as claimed in claim 1, wherein the guide plate and the side plate are parallel to the side panels of the receiving body.

7. The composite magazine for tackers as claimed in claim 1, wherein the at least one second positioning portion is located away from the open end of the receiving body, and the first positioning portion is located away from the bottom of the receiving body.

8. The composite magazine for tackers as claimed in claim 1, wherein the at least one second positioning portion is located close to the open end of the receiving body.

* * * * *